US005588610A

United States Patent [19]

McGee

[11] Patent Number: 5,588,610

[45] Date of Patent: Dec. 31, 1996

[54] POWER STRING AND CHALK LINE

[76] Inventor: Daniel McGee, P.O. Box 26, Greenbank, Wash. 98253

[21] Appl. No.: 503,816

[22] Filed: Jul. 18, 1995

Related U.S. Application Data

[63] Continuation-in-part of Ser. No. 393,080, Feb. 23, 1995, abandoned.

[51] Int. Cl.[6] ..... B44D 3/38

[52] U.S. Cl. ..... 242/379; 242/381

[58] Field of Search ..... 242/379, 381, 242/381.6, 385.1, 385.2, 385.3; 33/414, 767

[56] References Cited

U.S. PATENT DOCUMENTS

| | | | |
|---|---|---|---|
| 2,172,043 | 9/1939 | Wolf | 33/767 |
| 2,589,500 | 3/1952 | Landon et al. | 242/395.1 |
| 4,434,952 | 3/1984 | Czerwinski et al. . | |
| 4,565,011 | 1/1986 | Karger | 242/381.6 |
| 4,592,148 | 6/1986 | Longenette | 242/381.6 |
| 4,765,557 | 8/1988 | Kahmann | 242/381.6 |
| 5,163,230 | 11/1992 | Gast . | |
| 5,212,875 | 5/1993 | Corso . | |
| 5,444,919 | 8/1995 | Alves . | |

FOREIGN PATENT DOCUMENTS

| | | | |
|---|---|---|---|
| 1336553 | 11/1973 | United Kingdom | 33/767 |

*Primary Examiner*—John P. Darling
*Attorney, Agent, or Firm*—Christensen O'Connor Johnson & Kindness, PLLC

[57] ABSTRACT

A power string and chalk line tool for obtaining a straight line reference using a line having a wound end and a free end is provided. The tool includes a housing having an upper face and a lower face, a support rod mounted between the upper and lower faces, and a line aperture. A spool having two end plates separated by a hollow axle is sized to fit and rotatably mounted about the support rod inside the housing, such that the wound end of the line can be wound around the spool and the free end of the line can be pulled from the housing via the line aperture. A coil spring affixed to the spool maintains rotational tension on the spool, biasing the spool against unwinding the line from the spool and towards rewinding the line onto the spool. A speed control member is provided that is movably attached to the housing and extends adjacent the spool for applying pressure against the spool to create friction, thereby reducing the speed of or stopping spool rotation. A slip-lock member is provided that is attached to the spool and allows continuous movement of the spool in either direction, but restricts movement of the spool if continuous movement of the spool is desired to be halted. The present invention therefore provides a tool for easily extending a line to obtain a straight-line reference, and a mechanism for quickly and efficiently retrieving the line in a controlled manner once the reference is obtained.

7 Claims, 3 Drawing Sheets

POWER STRING AND CHALK LINE

This application is a continuation-in-part of my application Ser. No. 08/393,080 filed Feb. 23, 1995, now abandoned, entitled "Power String and Chalk Line Return."

FIELD OF THE INVENTION

The present invention generally relates to straight line and chalk line tools and, more specifically, to straight line and chalk line tools having locking and automatic line retrieval capability.

BACKGROUND OF THE INVENTION

Straight line and chalk line tools have long been used for various purposes to provide a straight line reference, whether by viewing of the tool's line (or string) simultaneous to its extension or by subsequent reference to a mark made by the tool's line after its chalk impression is left on the ground or other surface. Such tools have typically been hand-held devices wherein the line is unwound from a spool within the tool housing by an external force to a point distant the tool. If a chalk line mark is desired, the tool housing is filled with chalk prior to the removal of the line from the tool housing. Once the straight line reference is made with the extended line, or a chalk line is marked on the desired surface, the line is retracted into the tool housing and onto the spool by means of a handle or crank manually driven so as to reel in the line.

One prior art chalk line tool 10 is shown in FIG. 1. The illustrated chalk line tool 10 comprises a housing 12, a spool 14, a crank assembly 16, and a line 18 having a wound end and a free end. The housing 12 is pear-shaped and generally flat in nature, having an upper and a lower face separated by a continuous wall defining a spool chamber 20 located between the upper and lower face and at one end of the housing, the spool chamber tapering to a thinner neck 22 at the opposite end of the housing. The spool chamber 20 is sized to house the spool 14. Along the neck 22 of the housing 12 is an oblong chalk aperture 24 having a cover 26 slidably coupled to the housing 12 so as to cover and uncover the chalk aperture 24. The chalk aperture 24 provides access to the spool 14 and line 18 located on the interior of the housing 12 such that chalk can be placed within the housing to dust the line. A second aperture, namely a line aperture 28, is located at the end of the neck 22 of the housing 12 through which the free end of the line 18 is passed from the interior of the housing to a point external to the housing. The interior of the housing 12 further includes securing members 30 for securing the upper and lower face of the housing 12 together.

The spool 14 has opposing circular end plates 32 separated by and affixed to a cylindrical axle 34, and is rotatably mounted inside the housing 12 in the spool chamber 20. The crank assembly 16 includes a handle 36 mounted to a crank shaft 38, both of which are external to the housing 12, save for one end of the crank shaft 38, which is immovably affixed to the axle 34. Cranking movement of the handle 36 drivingly rotates the crank shaft 38, which in turn drivingly rotates the axle 34 and the associated end plates 32.

The line 18 is generally made of lightweight string. The wound end of the line is affixed to and wound around the spool 14, on the axle 34 and between the opposed end plates 32, with the line's free end passed out of the line aperture 28. The free end of the line generally has a hook 40 used to facilitate securing of the free end of the line to a stationary object (not shown) when a straight line reference is desired.

In typical operation, chalk is placed into the housing 12 via the chalk aperture 24, after which the cover 26 is closed to prevent chalk from escaping. The free end and hook 40 of the chalk-dusted line 18 is then removed from the line aperture 28 away from the housing 12, unwinding the line from the spool 14. After obtaining the straight line reference, the chalk-dusted line 18 is then retracted into the interior of the housing 12, rewinding the line onto the spool 14 by manually cranking the crank assembly 16, namely by turning the handle 36 and thereby drivingly rotating the spool 14 until the line is again secured on the spool within the end plates 32.

The manually driven crank assembly creates practical disadvantages in the use of existing straight line and chalk line tools. Specifically, existing line retrieval requires expenditure of both time and effort to manually retrieve the line from its extended position external the housing. These disadvantages are accentuated the further the line is removed from the housing. The present invention is directed to overcoming these disadvantages.

SUMMARY OF THE INVENTION

In accordance with the present invention, a power string and chalk line tool for automatic locking and retrieval of a straight or chalk line having a wound end and a free end is provided. The tool includes a housing having an upper face and a lower face, a support rod mounted between the upper face and the lower face, and a line aperture. A spool having two end plates separated by a hollow axle and sized to fit within the housing is rotatably mounted inside the housing, such that the wound end of the line can be wound around the spool and the free end of the line can be pulled from the housing via the line aperture. A coil spring affixed to the spool maintains rotational tension on the spool such that, as the line is unwound from the spool, the tension on the spring increases, biasing the spool against unwinding the line from the spool and towards rewinding the line onto the spool. The present invention therefore provides a tool for easily extending a line to obtain a straight-line reference, and a mechanism for quickly and efficiently retrieving the line in a controlled manner once the reference is obtained.

In accordance with further aspects of this invention, the housing further includes a sealable chalk aperture for inserting chalk into the housing so as to dust the line with chalk.

In accordance with still further aspects of this invention, the housing includes a chamber between the spool and the line aperture into which the chalk is inserted through a chalk aperture and through which the line passes as it is unwound from the spool, wherein the sealable chalk aperture opens into the chamber.

In accordance with still other aspects of this invention, a speed control member is provided that is pivotably attached to the housing and extends adjacent the spool for applying pressure against the spool to create friction, thereby reducing the speed of spool rotation.

In accordance with yet other aspects of this invention, a slip-lock member is attached to the spool that allows continuous movement of the spool in either direction, but restricts movement of the spool if continuous movement of the spool is halted.

As will be appreciated from the foregoing summary, the invention provides a power spring and chalk-line tool that provides for the automatic and controlled retrieval of line used to obtain a straight-line reference onto a spool. The present invention thereby reduces time and effort typically required for obtaining a straight-line reference. The present invention further maintains safety associated with line retrieval by providing a means of locking the line at a point distant from the tool, and thereafter retrieving the line at a desired speed into the tool housing.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
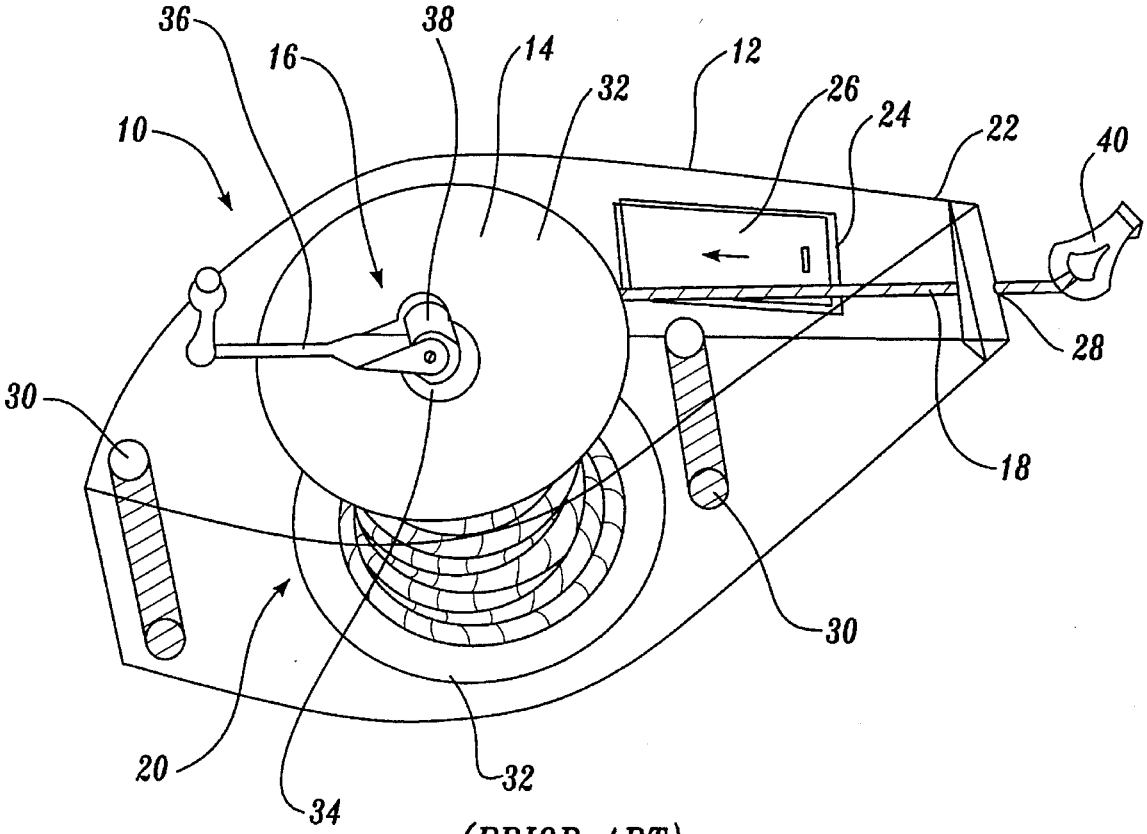
(PRIOR ART) Fig. 1
FIG. 1 is a cut-away perspective view of a prior art chalk line tool having a manually driven crank assembly.
Figure 2:
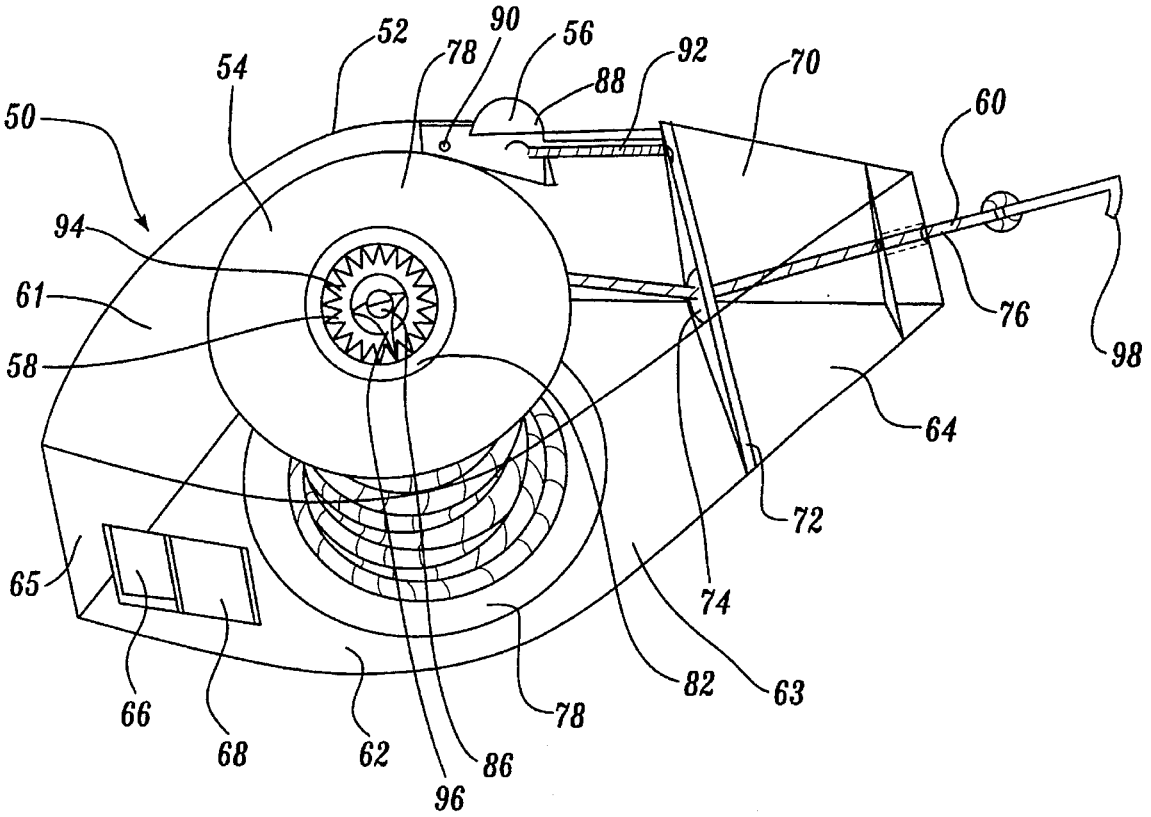
FIG. 2 is a cut-away perspective view of the a power string and chalk line tool made in accordance with the present invention.
Figure 3:
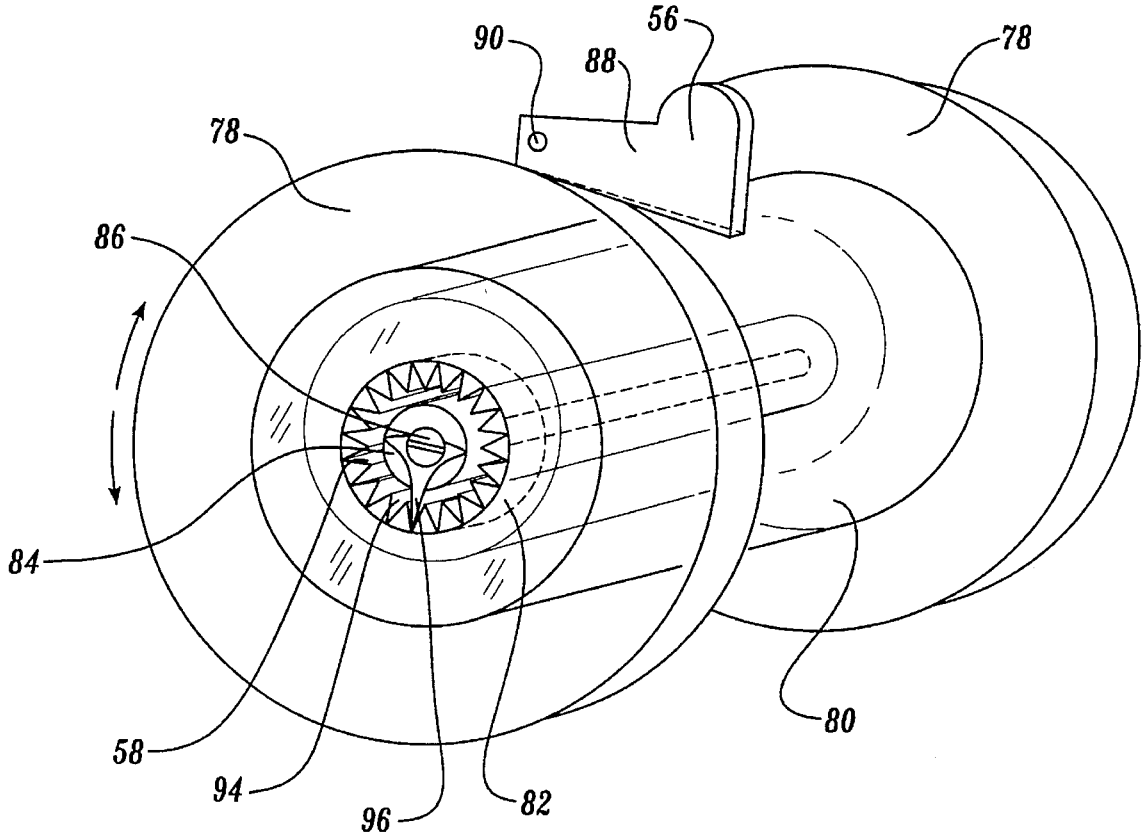
FIG. 3 is a fragmented perspective view of the power string and chalk line tool of FIG. 2 showing an automatic feeding and locking spool assembly made in accordance with the present invention.

An embodiment of a power string and chalk line tool 50 made in accordance with the present invention is illustrated in FIGS. 2 and 3. The tool 50 includes a housing 52, a spool assembly 54, a spool speed control assembly 56, a slip-lock assembly 58, and a line 60 having a wound end and a free end.

As is best understood by reference to FIG. 2, the housing 50 is pear-shaped and generally flat in nature, having an upper face 61 and a lower face 63 separated by a continuous wall 65 defining a spool chamber 62 located between the upper and lower face and at one end of the housing, the spool chamber tapering to a thinner neck 64 at the opposite end. The spool chamber 62 is sized to house the spool assembly 54. The housing 50 has a rectangular chalk aperture 66 having a cover 68 slidably coupled to the housing 52 so as to cover and uncover the chalk aperture 66. The chalk aperture 66 provides access to the spool assembly 54 and the line 60 located on the interior of the housing 52, such that chalk can be placed within the housing to dust the line. At the neck 64 of the housing 52 is a chamber 70 having a wall 72 separating the chamber from the spool chamber 62 of the housing. A spool guide aperture 74 is located in the wall 72 through which the free end of the line 60 can be passed. Opposing the wall 72, at the tapered end of the neck 64, is a line aperture 76 providing access for the free end of the line to be pulled out of the housing 52.

While in the present invention the chalk aperture 66 and corresponding cover 68 are located in the spool chamber 62 of the housing 52, in an alternate embodiment the chalk aperture and cover may equivalently be located in the neck 64 of the housing, such that chalk is inserted into the chalk chamber 70 and maintained separate from direct contact with the spool chamber 62 and spool assembly 54. This alternate embodiment as well as other functionally equivalent embodiments relating to the location and operation of the chalk aperture will therefore readily be appreciated.

As best understood by reference to FIG. 2 in conjunction with FIG. 3, the spool assembly 54 includes a hollow cylindrical axle 80 having protruding teeth 94 extending inward from the interior surface of the hollow cylindrical axle, opposing circular end plates 78 separated by and immovably affixed to the axle 80, a tension-stressed coil spring 82, and a support rod 84 having a threaded aperture at one end. The support rod 84 is located within and supports the axle 80, which in turn supports the spool assembly 54 within the housing 52. The support rod spans the internal distance between the upper face 61 and the lower face 63 and is used to secure the upper and lower faces of the housing 52 together. Specifically, one end of the support rod is affixed to the upper face 61, while the other end of the support rod has the threaded aperture. A screw 86 is inserted through the lower face 63 and into the threaded aperture of the support rod 84, thereby affixing the lower face 63 to the support rod 84 and therefore to the upper face 61. Between the axle 80 and the support rod 84 is a tension-stressed coil spring 82, one end of which is attached to the axle 80 while the other end is attached to the support rod 84. The coil spring 82 maintains tension on the spool as it is rotated in one direction, biasing the spool towards rotation in the opposite direction.

The speed control assembly 56 includes a generally rectangular pivotably movable control member 88 suspended above the end plate 78 of the spool assembly by means of a pivot pin 90 affixing one end of the control member 88 to the housing 52, and a control spring 92, attached to the other end of the control member 88 and the housing 52 so as to bias the control member 88 against movement towards the spool assembly 54. In operation, pressure is applied to the speed control assembly 56, causing the control member 88 to engage the end plate 78 of the spool assembly 54. The greater the pressure applied, the more friction against the rotation of the spool assembly, thereby causing the spool rotation to slow and/or completely stop as continued pressure is applied. The speed control assembly thus provides control for the movement of the line as it is retracted into the housing.

The slip-lock assembly 58 includes the axle 80, the support rod 84, and a flexible spring-band locking tab 96, immovably affixed via the screw 86 to the support rod 84, that extends outward from beyond the support rod 84 to engage the teeth 94 located on the interior surface of the axle 80, thereby locking the axle 80 against rotation. The slip-lock assembly allows continuous movement of the spool in one direction, while stopping movement in the opposite direction such that the extended line can be used to obtain a straight line reference. The tab 96 is flexible regardless of the direction of movement of the spool assembly 54. When the spool assembly is in continuous movement, the rotational force on the axle 80, caused either by an external force pulling out the line or by the recoiling tension of the spring 82 retracting the line, is sufficiently strong so that the flexible tab 96 does not prevent movement of the axle as it engages the teeth 94. When movement in a particular direction stops, however, the tab 96 catches the teeth 94, preventing movement of the spool assembly 54 and stopping extension or retraction of the line 60. In operation, as the line 60 is unwound from the spool assembly 54, the tab 96 does not engage the teeth 94 so as to prevent movement of the axle. When movement in that direction stops, the tab 96 engages the teeth 94 and, because the rotational force on the axle 80 is weak, prevents automatic retraction of the spool assembly 54. Subsequent short pressure on the line, caused by sharply pulling the line, creates sufficient rotational force on the axle 80 to disengage the tab 96 from the teeth 94, whereupon continuous movement of the spool assembly 54 to retract the line 60, motivated by the recoiling tension of the spring 82, prevents further engagement of the teeth 94 by the tab 96, thereby allowing complete retraction of the line. The slip-lock assembly thus provides control for the maintenance of the position of the line with respect to the housing.

The line 60 is generally made of a lightweight, strong string. The wound end of the line is wound around the spool assembly 54, on the spool axle 80 and between the opposed end plates 78. The free end of the line is passed through the guide aperture 74, chamber 70, and line aperture 76. The free end of the line external the housing 52 is attached to a hook 98 used to facilitate securing the free end of the line to a stationary object (not shown) when a straight-line reference is desired.

The operation of the present invention when a chalk line reference is desired can be described in conjunction with the description provided above. Chalk is placed into the housing 52 via the chalk aperture 66, after which the cover 68 is closed to prevent chalk from escaping. The free end and hook 98 of the chalk-dusted line 60 is then removed from the line aperture 76 away from the housing 52, unwinding the line from the spool assembly 54. After obtaining the straight line reference, the chalk dusted line 60 is then retracted into the interior of the housing 52, rewinding the line onto the spool assembly 54, motivated by the automatic recoiling of the spring 82, until the line is again secured on the axle 80 between the end plates 32.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A straight line or chalk line tool for obtaining a straight line reference using a line having a wound end and a free end, comprising:

(a) a housing having an upper face and a lower face, a support rod mounted between the upper and the lower face, and a line aperture;

(b) a spool, having two end plates separated by a hollow axle, sized to fit within the housing and rotatably mounted about the support rod inside the housing, such that the wound end of the line can be wound around the spool and the free end of the line can be pulled from the housing via the line aperture;

(c) a coil spring, affixed to the spool, for maintaining rotational tension on the spool, such that as the free end of the line is pulled from the spool, the rotational tension of the spring increases, biasing the spool against removal of the line from the spool and toward rewinding line onto the spool; and (d) a slip-lock means that allows continuous movement of the spool in either direction, but restricts movement of the spool if continuous movement of the spool is halted.

2. The tool of claim 1, wherein the housing further includes a sealable chalk aperture for inserting chalk into the housing.

3. The tool of claim 2, wherein:

(a) the housing further includes a chamber between the spool and the line aperture into which the chalk is inserted and through which the line passes as it is unwound from the spool; and (b) the sealable chalk aperture is adapted to open into the chamber.

4. The tool of claim 3, wherein the chamber includes a wall between the spool and the line aperture having a guide aperture through which the line is passed.

5. The tool of claim 1, further including a speed control means for applying pressure against the spool to create friction, thereby reducing the speed of spool rotation.

6. The tool of claim 5, wherein the speed control means includes a member having a first end and a second end, wherein the first end is pivotably attached to the housing and the second end is attached to the housing via a spring, such that the member is suspended near and biased against contact with the spool.

7. The tool of claim 1, wherein:

(a) the hollow interior of the axle includes protruding teeth extending inward; and (b) the slip-lock means includes a flexible spring tab, immovably affixed to the support rod of the housing, such that when the spool is in continuous movement, the rotational force on the axle is sufficiently strong so that the tab does not prevent movement of the axle, but when spool movement stops, the tab catches the protruding teeth, thereby preventing movement of the spool caused only by rotational tension of the coil spring.

* * * * *